US005114035A

United States Patent [19]

Brown

[11] Patent Number: 5,114,035

[45] Date of Patent: May 19, 1992

[54] VEHICLE RADIATOR CAP

[75] Inventor: David M. Brown, Oregon, Ill.

[73] Assignee: Epicor Industries, Inc., Deerfield, Ill.

[21] Appl. No.: 785,943

[22] Filed: Oct. 31, 1991

[51] Int. Cl.[5] ..... B65D 51/16

[52] U.S. Cl. ..... 220/203; 220/209; 220/303; 220/DIG. 32

[58] Field of Search ..... 220/203, 204, 209, 293, 220/295, 298, 301, 303, DIG. 32, DIG. 33

[56] References Cited

U.S. PATENT DOCUMENTS

| | | | |
|---|---|---|---|
| 2,195,266 | 2/1939 | Bailey . | |
| 2,679,946 | 6/1954 | Friend | 220/303 X |
| 2,918,191 | 12/1959 | Pipes et al. . | |
| 2,968,421 | 1/1961 | Eshbaugh . | |
| 2,990,971 | 7/1961 | Enell | 220/303 X |
| 3,027,043 | 3/1962 | Nestic . | |
| 3,061,138 | 10/1962 | Edelmann et al. . | |
| 3,074,588 | 1/1963 | Burdue . | |
| 3,111,239 | 11/1963 | Ivins . | |
| 3,186,580 | 6/1965 | Previte . | |
| 3,189,213 | 6/1965 | Nimmo . | |
| 3,373,894 | 3/1968 | Johnson . | |
| 3,715,049 | 2/1973 | McMullen . | |
| 3,878,965 | 4/1975 | Crute | 220/295 |
| 3,910,451 | 10/1975 | Tusing . | |
| 4,079,855 | 3/1978 | Avrea . | |
| 4,136,795 | 1/1979 | Crute et al. . | |
| 4,185,751 | 1/1980 | Moore et al. | 220/203 |
| 4,241,845 | 12/1980 | Daly et al. . | |
| 4,271,976 | 6/1981 | Detwiler . | |
| 4,498,599 | 2/1985 | Avrea | 220/203 |

*Primary Examiner*—Stephen P. Garbe
*Assistant Examiner*—Nova Stucker
*Attorney, Agent, or Firm*—Allegretti & Witcoff, Ltd.

[57] ABSTRACT

A vehicle radiator cap for closing a radiator filler neck is disclosed. The radiator cap includes a central rivet for securing a crown, a bell housing, and a discoid spring and having a flared shank permitting free turning of the crown relative to the primary sealing gasket. The cap further includes a pressure spring nested within the bell housing and centered directly above an annular valve seat in the radiator filler neck. The upper turn of the spring nests in the shoulder region of the bell housing and the bottom turn biases a seal support plate against the annular valve seat. The seal support plate has an integrally formed cylinder having a lip which retains a vacuum seal in sealing relationship with the bottom surface of the seal support plate.

9 Claims, 2 Drawing Sheets

VEHICLE RADIATOR CAP

BACKGROUND OF THE INVENTION

1. Field of the Invention

The present invention relates generally to vehicle radiator caps of the type commonly associated with radiator fluid reservoirs for internal combustion engines. More particularly, the present invention relates to an improved vehicle radiator cap design having a reduced number of component parts and other novel and useful features of construction which enhance the performance and reliability of the cap, while appreciably reducing the manufacturing costs for the cap.

2. Background Art

Internal combustion engines which are liquid cooled incorporate radiators coupled to the engines to dissipate heat generated by the engine. As the radiator fluid passes through the radiator, heat is given off to the environment, and the now relatively cooler fluid is returned to the engine. Radiator caps are designed to engage with the filler neck of the radiator and perform a number of specific functions, the primary one being to provide a seal for the filler neck of the radiator fluid reservoir.

After the engine is started, the operating temperature of the engine increases, causing an increase in the pressure in the radiator. Radiator caps typically include a pressure relief valve which is normally closed to prevent the escape of radiator fluid when normal pressures are generated within the radiator. However, when the pressure in the radiator build up beyond the strength of the pressure relief spring, the valve is pushed open and radiator fluid escapes past the pressure relief valve. In most modern automobiles, the overflow radiator fluid flows out of a port in the radiator filler neck into an overflow tank. The overflow fluid or coolant is returned to the tank upon the development of vacuum or subatmospheric pressure within the radiator after the engine has cooled. Radiator caps also typically have a vacuum relief valve which opens in response to the development of subatmospheric pressure within the radiator in order to facilitate the return of coolant from the overflow tank to the radiator reservoir proper. In addition to performing these functions, a radiator cap should also provide a free turning crown such that during the manual engagement of the cap with the filler neck, the primary sealing element which makes contact with the filler neck is not scuffed as the crown is rotated into engagement with the filler neck, as repeated scuffing causes a weakening and deterioration of the sealing element.

Workers in the art have produced a number of radiator cap designs to accomplish these basic tasks, representative examples being U.S. Pat. No. 3,878,965, issued to Crute and U.S. Pat. No. 4,185,751, issued to Moore et al. However, the prior art designs such as the Moore et al. and Crute patents require as many as 13 or more individual components to be manufactured and assembled in order to make a functioning cap. For example, the Crute patent provides a free turning crown, but the design requires an additional, discrete member to be retained by a central rivet, thus increasing the design's cost and complexity. As radiator caps are typically manufactured in very large quantities to meet the demands of the automotive industry, there is a genuine need for improvements in design which translate into reduced manufacturing costs and simplification and ease of assembly, while improving the performance and reliability of the design. Moreover, as radiator caps function under conditions of high temperature, pressure and humidity, they are subject to mechanical stresses which, over time, can cause metal and plastic parts to creep, that is, to become distorted. Thus, there is a need for a radiator cap design which reduces the stresses on the components, thereby making the radiator cap more durable and reliable.

Accordingly, it is an object of the present invention to reduce the costs associated with the manufacture of a radiator cap, while improving the reliability and performance of the cap.

A further object of the present invention is to provide a radiator cap of increased ease of manufacture and assembly having a reduced number of component parts.

SUMMARY OF THE INVENTION

These and other objects, advantages, and features of the invention are provided in a radiator cap for closing the filler neck of a radiator fluid reservoir. The cap comprises a manually manipulable crown covering the filler neck and including cam fingers for engaging the crown with the filler neck. The crown is provided with a central aperture. The cap further includes a discoid spring having a central aperture, and a bell housing having a central aperture. A central rivet extends through the central apertures and retains the crown, discoid spring, and bell housing. The bell housing has an upper shoulder region supporting a discoid rubber seal for sealing the filler neck. The bell housing also has a lower radially outwardly extending flange, which carries a pressure-vacuum valve assembly. The cap further includes a pressure relief spring in the form of a coil nested within the bell housing and having an upper turn or convolution which engages the upper shoulder region of the bell housing, and a lower turn biasing the pressure-vacuum valve assembly to a seating position against an annular filler neck valve seat. In one aspect of the invention, the lower turn of the pressure spring is centered above and aligned with the annular valve seat to thereby reduce stresses on the pressure-vacuum valve assembly and bell housing. In another aspect of the invention, the pressure-vacuum valve assembly comprises a vacuum seal, a seal support plate having an integrally formed seal retention means for retaining the vacuum seal, and a vacuum valve. In yet another aspect of the invention, the central rivet includes a flared shank retaining the discoid spring and the bell housing, permitting free turning of the crown relative to the discoid rubber seal as the cap is installed on the filler neck.

BRIEF DESCRIPTION OF THE DRAWINGS

There is shown in the attached drawing a presently preferred embodiment of the present invention, wherein like numerals refer to like elements in the various views.

DETAILED DESCRIPTION OF THE PREFERRED EMBODIMENT

Figure 1:
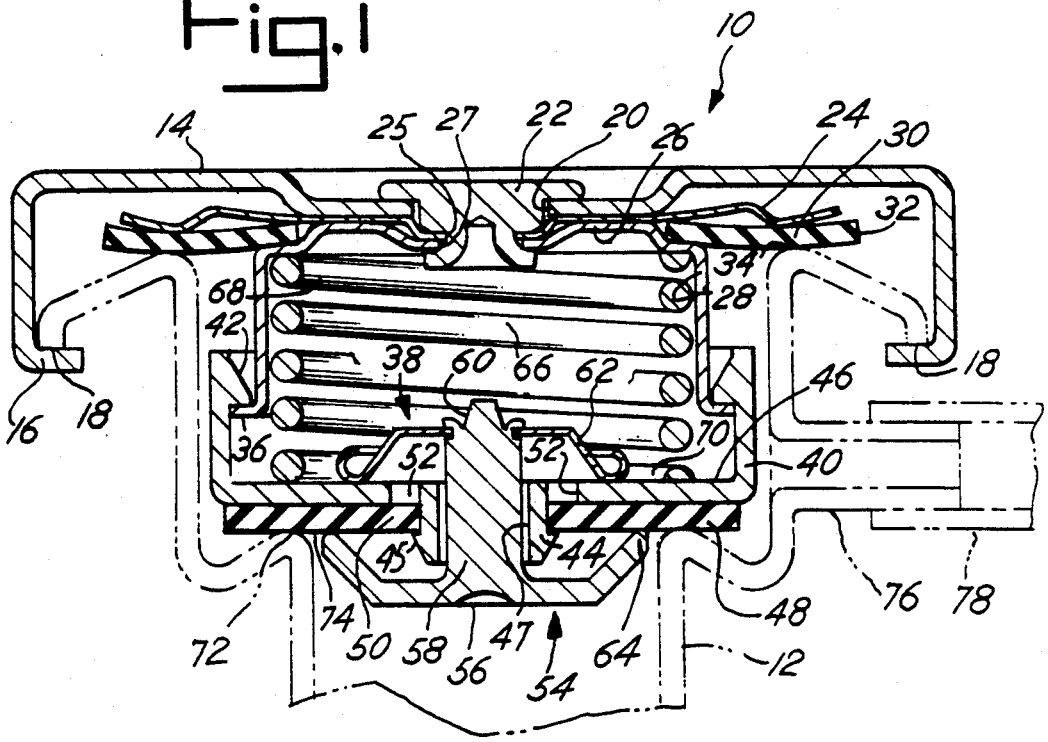
FIG. 1 is a cross-sectional view of the radiator cap of the present invention installed on a radiator filler neck.

Referring now to FIG. 1, the radiator cap 10 according to a preferred embodiment of the invention is shown installed on a conventional radiator filler neck 12. The cap 10 includes a manually manipulable crown or shell 14 covering the filler neck 12. The crown 14 has a pair of oppositely opposed cam fingers 16 which pass through corresponding openings (not shown) in the filler neck and engage the lip 18 of the filler neck 12 when the crown 14 is rotated onto the filler neck 12 to thereby secure the cap 10 to the filler neck 12. The crown 14 also is shown as having a central aperture 20. A rivet 22 extends through the aperture 20 and after staking to its flared shape secures in an assembled condition the crown 14, a discoid spring 24 having a central aperture 25, and a bell housing 26 having a central aperture 27.

The bell housing 26 has an upper shoulder region 28 which supports a discoid rubber seal 30. The rubber seal has an outer peripheral region 32 which makes sealing contact with an upper annular seat 34 of the filler neck 12. The discoid spring 24 serves to exert downward forces onto the outer peripheral region 32 of the rubber seal 30 to ensure sealing contact is made between the rubber seal 30 and the annular seat 34 when the cap 10 is rotated onto the filler neck 12. By using the upper shoulder region 28 of the bell housing to support the rubber seal 30, the necessity of using a support member for the seal as a discrete structural element as is often found in prior art designs is eliminated.

The bell housing 26 includes a lower radially outwardly extending flange 36 which carries a pressure-vacuum valve assembly 38. The valve assembly 38 includes a seal support plate 40 having its downward movement limited by the abutment of the flange 36 with a plurality of inwardly projecting tabs 42 on the seal support plate 40. The seal support plate 40 includes a downwardly projecting cylinder 44 integrally formed with the base portion 46. The lip 45 of cylinder 44 lightly grips a vacuum seal 48, and serves as a means for retaining the vacuum seal 48 adjacent the seal support plate 40. The vacuum seal 48 can be fabricated from a resilient material, such as rubber. The lip design of the cylinder 45 eliminates the need for an eyelet retainer or grommet typically found in the prior art and used to hold the vacuum seal 48 adjacent the seal support plate. The inner peripheral region 50 of the vacuum seal 48 closes off a plurality of apertures 52 in the base portion 46 of the seal support plate 40. The valve assembly 38 also includes a vacuum valve 54 comprising a valve head 56 and an elongate shank 58. The shank 58 extends through the cylinder 44 and has an upper end 60 which is staked to retain a leaf spring 62. The leaf spring 62 biases the vacuum valve 54 to a closed position such that the annular perpherial region 64 of the valve head 56 exerts upward forces on the vacuum seal 48, pressing vacuum seal 48 against the seal support plate 40 to seal the apertures 52 and the primary path for air and fluid flow, i.e., the clearance region between inner wall 47 of the cylinder 44 and the shank 58 of vacuum valve 54.

The radiator cap 10 further includes a pressure spring 66 nested inside the bell housing 26. The pressure spring 66 is a coil spring having an upper turn 68 snugly engaging the upper shoulder region 28 of the bell housing 26, obviating the need for a separate structural element to act as a stop for the pressure spring 66 as often found in the prior art. Pressure spring 66 has a lower turn 70 biasing the base portion 46 of the seal support plate 40. In another aspect of the invention, the pressure spring 66, seal support plate 40 and bell housing 26 are designed so that when the cap 10 is installed on the filler neck 12, the seal support plate 40 is under a minimum of stress. As the seal support plate is subject to high temperatures, humidities and pressures for long periods of time, the seal support plate 40 is prone to creep or distortion, which can lead to a reduction of the sealing capabilities of the vacuum seal 48. It can be seen from FIG. 1 that the lower turn 70 of pressure spring 66 is designed to be centered over and apply forces substantially directly above the annular valve seat 72 of the filler neck 12, thus reducing the possibility of any creep or distortion of the seal support plate over a long period of time. Also, the snug fitting of the upper turn 68 of pressure spring 66 in the shoulder region 28 of bell housing 26 reduces the likelihood of any creep occurring in the shoulder region of bell housing 26. The references to upper, lower and downwardly with respect to FIG. 1 are for purposes of explanation.

Figure 2:
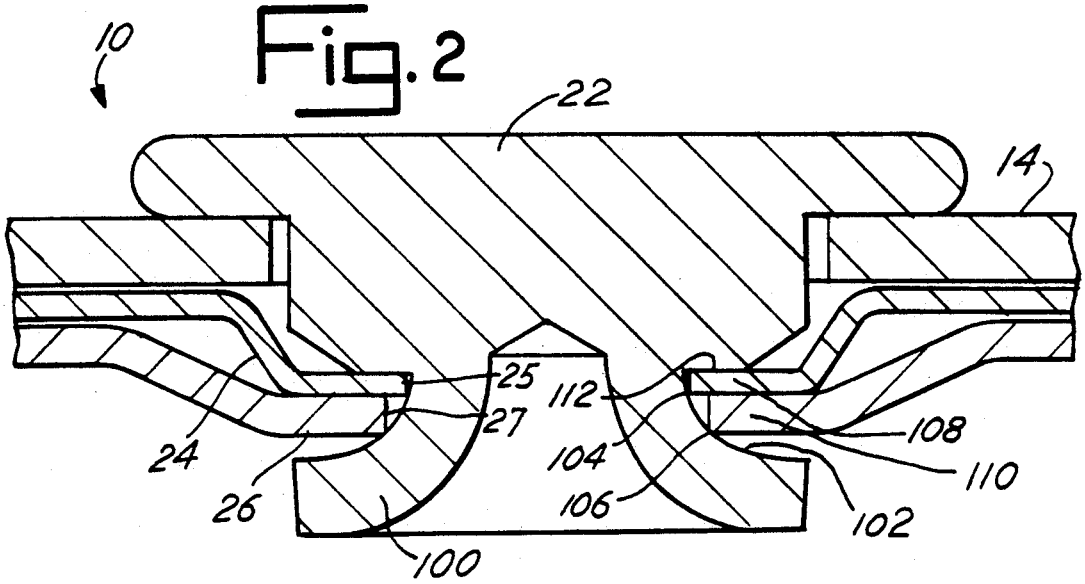
FIG. 2 is a fragmentary, enlarged cross-sectional view of the central rivet region of the radiator cap of FIG. 1.

Referring now to FIG. 2, the central rivet region of cap 10 is shown in greater and enlarged detail. The rivet 22 has a flared shank 100, thereby permitting the discoid spring 24 and bell housing 26 to make a positive step contact with the outer curved surface 102 of the flared shank 100. After the staking of rivet 22, the outer curved surface 102 presses the innermost regions 108 and 110 of the discoid spring 24 and bell housing 26, respectively, against the bottom surface 112 of the rivet head. The flared shank design ensures that both the discoid spring 24 and bell housing 26 make contact at contact points 104 and 106, thus ensuring that no fluid or vapor leak path exists past the apertures 25 and 27 of the discoid spring 24 and bell housing 26, respectively. The pinching fit of the discoid spring 24 and bell housing 26 between the flared shank 100 and the bottom surface 112 results in the binding together of rivet 22, bell housing 26 and discoid spring 24. Referring to FIGS. 1 and 2, when the cap 10 is installed on the filler neck and the crown 14 is drawn down by virtue of the engagement of the cam fingers 16 with the lip of the filler neck, the rivet 22, bell housing 26 and discoid spring 24 remain stationary while only the crown 14 moves relative to the filler neck 12. Thus, the discoid rubber seal 30 is not scuffed during the installation and removal of the cap 10 from the filler neck 12.

Figure 3:
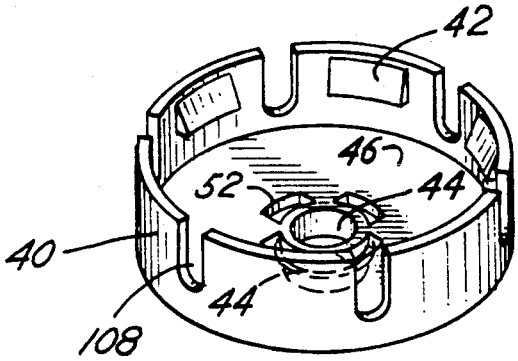
FIG. 3 is perspective view of the seal support plate of FIG. 1.

FIG. 3 is a perspective view of the seal support plate 40. The seal support plate 40 has a plurality of tabs 42 projecting inwardly which cooperate with the flange 36 of the bell housing 26 (FIG. 1) to limit the downward movement of the seal support plate 40 relative to the bell housing 26. The seal support plate 40 also has a plurality of cutouts 108 through which radiator fluid passes as it returns from the overflow tank to the radiator. Referring to FIG. 3 and FIG. 1, the fluid passes through the cutouts 108 down through the clearance region between cylinder 44 and shank 58 around the valve head 56 of the vacuum valve 54 upon the development of subatmospheric pressure within the radiator, as hereinbefore described.

Figure 4:
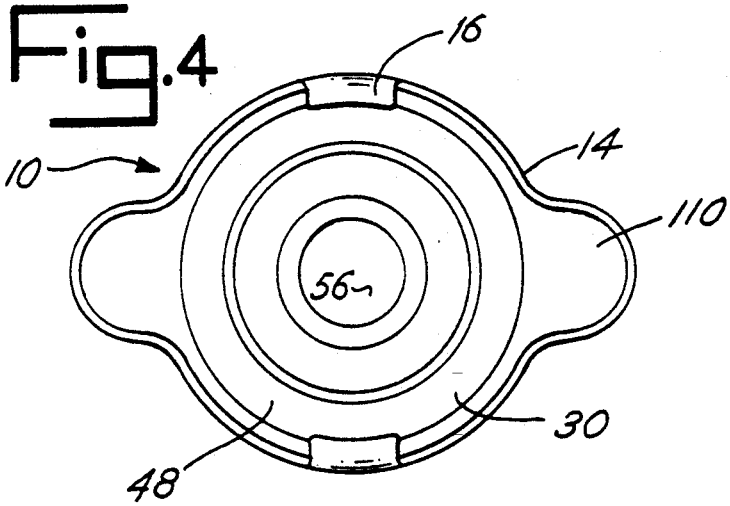
FIG. 4 is a bottom view of the assembled radiator cap of FIG. 1.

FIG. is an illustration of the radiator cap 10, as seen from below, in an assembled condition. The crown 14 includes grip projections 110 which facilitate the turning of the crown 14 and the installation and removal of the cap 10. FIG. 4 also shows cam fingers 16 which rotatably engage the lip 18 of the filler neck 12 (FIG. 1).

Figure 5:
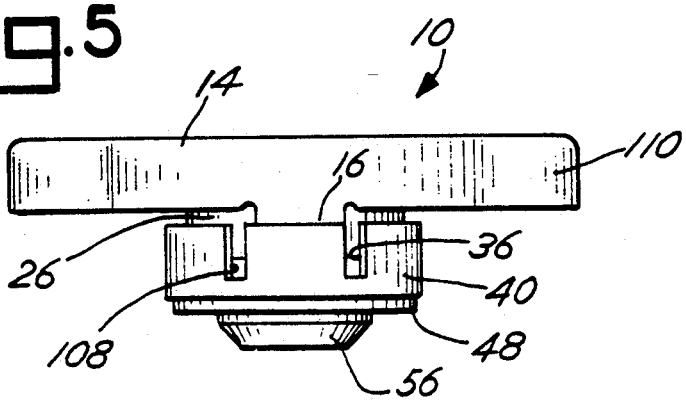
FIG. 5 is a side elevational view of the assembled cap of FIG. 1.

Referring now to FIG. 5, the cap 10 of the present invention is shown in a side elevational view, showing cutouts 108 in the seal support plate 40 and valve head 56 retaining vacuum seal 48 in sealing relationship to the seal support plate 40.

In operation, the bottom turn 70 of the pressure spring 66 exerts downward forces on the seal support plate 40 such that the vacuum seal 48 maintains sealing contact with the annular valve seat 72 of the filler neck 12 under normal operating conditions. Upon the development of abnormally high superatmospheric pressure in the radiator, creating upward pressures on the valve head 56 and peripheral region 74 of the seal 48, the valve assembly 38 lifts bodily upward, permitting the flow of radiator fluid around the valve seal 48 and out an overflow port 76 through a tube 78 running to an overflow tank (not shown in FIG. 1). Upon the development of subatmospheric pressures within the radiator when the engine has cooled, the valve assembly 38 reseats on valve seat 72 and vacuum valve 54 opens, thereby allowing coolant to be siphoned back from the overflow tank to pass through the clearance region between cylinder 44 and shank 58, and past the perpherial region 64 of the valve head 54 to return to the radiator fluid reservoir.

While I have described herein a preferred embodiment of the present invention, it is to be understood that changes and modifications can be made without departing from the true scope and spirit of the present invention. This true scope and spirit are defined by the following claims and their equivalents, to be interpreted in light of the foregoing specification.

What is claimed is:

1. A radiator cap for closing the filler neck of a radiator fluid reservoir, said filler neck having an annular valve seat, comprising:

a manually manipulable crown covering said filler neck and including means for engaging said crown with said filler neck, said crown having a central aperture;

a discoid spring having a central aperture;

a discoid rubber seal;

a bell housing having a central aperture, an upper shoulder region and a lower radially outwardly extending flange, said upper shoulder region supporting said discoid rubber seal for sealing said filler neck;

a central rivet extending through said apertures and retaining said crown, discoid spring and bell housing;

a pressure-vacuum valve assembly carried by said flange; and a pressure relief spring nested within said bell housing having an upper turn engaging said upper shoulder region of said bell housing and a lower turn biasing said pressure-vacuum valve assembly against said annular valve seat.

2. The cap as claimed in claim 1 wherein said lower turn of said pressure spring is centered above and aligned with said annular valve seat to urge said pressure-vacuum valve assembly towards said seat, thereby reducing stress on said pressure-vacuum valve assembly.

3. The cap as claimed in claim 2 wherein said pressure-vacuum valve assembly comprises:

a vacuum seal;

a seal support plate having an integrally formed seal retention means for retaining said vacuum seal, said lower turn biasing said seal support plate; and a vacuum valve.

4. The cap as claimed in claim 3, wherein said pressure-vacuum valve assembly further comprises vacuum spring means retained by said vacuum valve for biasing said vacuum valve to a closed position to retain said vacuum seal in a sealing relationship to said seal support plate.

5. The cap as claimed in claim 4 wherein said seal retention means comprises a downwardly projecting cylinder integrally formed with said seal support plate having lip means for retaining said vacuum seal adjacent to said bottom surface of said seal support plate.

6. The cap as claimed in claim 5 wherein said vacuum spring means comprises a leaf spring, and wherein said vacuum valve comprises a valve head and an elongate shank, said shank extending through said downwardly projecting cylinder and having a head, said head including means for retaining said leaf spring.

7. The cap as claimed in claim 1 wherein said central rivet includes a flared shank retaining said discoid spring and said bell housing.

8. The cap as claimed in claim 7 wherein said flared shank makes step contact with said discoid spring and said bell housing, thereby enhancing the sealing properties of said cap.

9. The cap as claimed in claim 8 wherein said flared shank of said rivet secures said discoid spring and said bell housing to said rivet, thereby permitting free turning of said crown relative to said discoid rubber seal as said cap is installed on said filler neck.

* * * * *